US006424919B1

(12) United States Patent
Moran et al.

(10) Patent No.: US 6,424,919 B1
(45) Date of Patent: Jul. 23, 2002

(54) METHOD FOR DETERMINING PREFERRED DRILL BIT DESIGN PARAMETERS AND DRILLING PARAMETERS USING A TRAINED ARTIFICIAL NEURAL NETWORK, AND METHODS FOR TRAINING THE ARTIFICIAL NEURAL NETWORK

(75) Inventors: David P. Moran; James A. Robertson, both of The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/603,321

(22) Filed: Jun. 26, 2000

(51) Int. Cl.[7] ..... G06F 19/00
(52) U.S. Cl. ..... 702/6
(58) Field of Search ..... 702/9, 6; 703/10

(56) References Cited

U.S. PATENT DOCUMENTS

| | | | | |
|---|---|---|---|---|
| 5,318,136 A | | 6/1994 | Rowsell et al. | 175/24 |
| 5,704,436 A | | 1/1998 | Smith et al. | 175/27 |
| 5,730,234 A | | 3/1998 | Putot | 175/50 |
| 5,794,720 A | | 8/1998 | Smith et al. | 175/40 |
| 5,812,068 A | | 9/1998 | Wisler et al. | 340/855.5 |
| 5,862,513 A | * | 1/1999 | Mezzatesta et al. | 702/9 |
| 6,002,985 A | | 12/1999 | Stephenson | 702/13 |
| 6,012,015 A | | 1/2000 | Tubel | 702/6 |
| 6,021,377 A | | 2/2000 | Dubinsky et al. | 702/9 |
| 6,044,325 A | | 3/2000 | Chakravarthy et al. | 702/7 |
| 6,109,368 A | | 8/2000 | Goldman et al. | 175/39 |
| 6,169,967 B1 | | 1/2001 | Dahlem et al. | 703/10 |
| 6,192,998 B1 | | 2/2001 | Pinckard | 175/27 |

FOREIGN PATENT DOCUMENTS

| | | |
|---|---|---|
| EP | 0 718 641 A2 | 6/1996 |
| GB | 2 328 466 | 2/1999 |
| GB | 2 340 944 | 3/2000 |
| GB | 2 352 046 | 1/2001 |
| WO | WO 00/17487 | 3/2000 |

OTHER PUBLICATIONS

Lee et al., "An Abductive Network for Predicting Tool Life in Drilling", IEEE/IAS Conference on Industrial Automation and Control: Emerging Tec 1995, May 22–27, 1995, pp. 717–722.*

Karri, Vishy, "RBF Neural Network for Thrust and Torque Predictions in Drilling Operations", Computational Intelligence and Multimedia Applications 1999, ICCIMA '99, Proceedings, Third International Conference on, Sep. 23–26, 1999, pp. 55–59.*

Jeff S. Arbogast and Mark H. Franklin, "Artificial Neural Networks and High–Speed Resistivity Modeling . . . Powerful New Exploration and Development Tools"; Hart's Petroleum Engineer International Magazine (in two parts), May and Jun., 1999.

D. Dashevskly et al. "Application of Neural Networks for Predictive Control in Drilling Dynamics"; Society of Petroleum Engineers 56442, 1999 SPE Annual Technology Conference and Exhibition, Houston, Texas; Oct. 3–6, 1999.

* cited by examiner

*Primary Examiner*—Donald E. McElheny, Jr.
(74) *Attorney, Agent, or Firm*—Rosenthal & Osha L.L.P.

(57) ABSTRACT

A method for selecting a design parameter for a drill bit is disclosed. The method includes entering a value of at least one property of an earth formation to be drilled into a trained neural network. The neural network is trained by selecting data from drilled wellbores. The data comprise values of the formation property for formations through which the drilled wellbores have penetrated. Corresponding to the values of formation property are values of at least one drilling operating parameter, the drill bit design parameter, and values of a rate of penetration and a rate of wear of a drill bit used on each of the formations. Data from the wellbores are entered into the neural network to train it, and the design parameter is then selected based on output of the trained neural network.

37 Claims, 5 Drawing Sheets

METHOD FOR DETERMINING PREFERRED DRILL BIT DESIGN PARAMETERS AND DRILLING PARAMETERS USING A TRAINED ARTIFICIAL NEURAL NETWORK, AND METHODS FOR TRAINING THE ARTIFICIAL NEURAL NETWORK

BACKGROUND OF THE INVENTION

The invention is related generally to the field of rotary wellbore drilling. More specifically, the invention relates to methods for optimizing values of drilling variables, or parameters, to improve or optimize drilling performance.

Wellbore drilling, such as is used for petroleum exploration and production, includes rotating a drill bit while applying axial force to the drill bit. The rotation and the axial force are typically provided by equipment which includes a drilling "rig". The rig includes various devices thereon to lift, rotate and control segments of drill pipe which ultimately connect the drill bit to the equipment on the rig. The drill pipe includes an hydraulic passage generally in its center through which drilling fluid is pumped. The drilling fluid discharges through selected-size orifices in the bit ("jets") for the purposes of cooling the drill bit and lifting rock cuttings out of the wellbore as it is being drilled.

The speed and economy with which a wellbore is drilled, as well as the quality of the hole drilled, depend on a number of factors. These factors include, among others, the mechanical properties of the rocks which are drilled, the diameter and type of the drill bit used, the flow rate of the drilling fluid, and the rotation speed and axial force applied to the drill bit. It is generally the case that for any particular mechanical properties of rocks, a rate at which the drill bit penetrates the rock ("ROP") corresponds to the amount of axial force on and the rotary speed of the drill bit. The rate at which the drill bit wears out is generally related to the ROP. Various methods have been developed to optimize various drilling parameters to achieve various desirable results.

U.S. Pat. No. 5,704,436 issued to Smith et al, for example, describes a method for determining an optimum drilling power (rate at which rock is drilled—directly corresponding to ROP) for a selected drill bit type and rock formation having known or otherwise determinable compressive strength. Generally speaking, the method in the Smith et al '436 patent includes developing a correlation between drilling power and wear rate for the selected bit type and for a particular formation compressive strength. Above a particular drilling power value ("maximum drilling power"), the wear rate of the selected type bit is purported to increase at an unacceptably high rate. The drilling power is controlled for an expected-to-be-drilled earth formation to a value below the maximum drilling power. One aspect of the method disclosed in the Smith et al '436 patent is to make some prediction about compressive strength of rocks to be drilled, or being drilled, and select the drilling power to remain below the maximum drilling power for the particular compressive strength rock being or to be drilled.

U.S. Pat. No. 5,318,136 issued to Roswell et al discloses a method for optimizing drilling parameters to provide a lowest financial cost of drilling a selected portion of, or all of a wellbore. Generally speaking, a rate of penetration ("ROP") for a to-be-drilled earth formation is selected, by controlling rotation speed and axial force, to provide a value of ROP for which the financial cost of drilling the segment of wellbore is minimized.

Prior art methods for determining preferred or optimal values of drilling parameters typically focus on rock compressive strength as a principal independent variable. Other properties of earth formations are related to optimal values of drilling parameters.

Artificial Neural Networks (ANNs) are a relatively new data processing mechanism. ANNs emulate the neuron interconnection architecture of the human brain to mimic the process of human thought. By using empirical pattern recognition, ANNs have been applied in many areas to provide sophisticated data processing solutions to complex and dynamic problems (i.e. classification, diagnosis, decision making, prediction, voice recognition, military target identification, to name a few). Similar to the human brain's problem solving process, ANNs use information gained from previous experience and apply that information to new problems and/or situations. The ANN uses a "training experience" (data set) to build a system of neural interconnects and weighted links between an input layer (independent variable), a hidden layer of neural interconnects, and an output layer (the results, i.e. dependant variables). No existing model or known algorithmic relationship between these variables is required, but could be used to train the ANN. An initial determination for the output variables in the training exercise is compared with the actual values in a training data set. Differences are back-propagated through the ANN to adjust the weighting of the various neural interconnects, until the differences are reduced to the user's error specification. Due largely to the flexibility of the learning algorithm, non-linear dependencies between the input and output layers, can be "learned" from experience. Several references disclose various methods for using ANNs to solve various drilling, production and formation evaluation problems. These references include U.S. Pat. No. 6,044,325 issued to Chakravarthy et al, U.S. Pat. No. 6,002,985 issued to Stephenson et al, U.S. Pat. No. 6,021,377 issued to Dubinsky et al, U.S. Pat. No. 5,730,234 issued to Putot, U.S. Pat. No. 6,012,015 issued to Tubel and U.S. Pat. No. 5,812,068 issued to Wisler et al.

SUMMARY OF THE INVENTION

One aspect of the invention is a method for selecting a value of a drilling operating parameter. The method include entering a design parameter for a drill bit into a trained neural network, entering a value of a property of an earth formation to be drilled into the trained neural network and selecting the value of the drilling operating parameter based on an output of the trained neural network.

Another aspect of the invention is a method for selecting a design parameter for a drill bit. The method according to this aspect includes entering a property of an earth formation to be drilled by the bit into a trained neural network, and selecting the design parameter based on output of the trained neural network.

Another aspect of the invention is a method for optimizing an economic performance of a drill bit, including entering a value of a property of an earth formation to be drilled by the bit into a trained neural network, entering a design parameter of the drill bit into the trained neural network, and adjusting a value of a drilling operating parameter in response to output of the trained neural network so as to optimize a value of a parameter related to the economic performance.

Another aspect of the invention is a method for simulating performance of a drill bit drilling an earth formation, including entering a property of the earth formation into a trained neural network, entering a design parameter of the drill bit into the trained neural network, entering a drilling operating parameter into the trained neural network, and determining a value of a drilling performance parameter based on an output of the trained neural network.

Another aspect of the invention is a method for estimating change in economic performance of a drill bit in response to change in an input parameter, including entering a property of an earth formation to be drilled by the bit into a trained neural network, entering a design parameter of the bit into the trained neural network entering a drilling operating condition into the trained neural network, and varying at least one of the property of said earth formation, the design parameter and the drilling condition, and then determining a change in a value of a parameter related to the economic performance.

In the various aspects of the invention, representative formation parameters include electrical resistivity, acoustic velocity, natural gamma ray radiation, compressive strength and abrasiveness. Representative bit design parameters include cutting element count, cutting element type and hydraulic nozzle configuration. Representative drilling operating parameters include weight on bit, rotary speed of the bit and drilling fluid flow rate. Representative economic performance parameters include wear rate of the bit and rate of penetration of the bit.

In example embodiments, the neural network is trained by entering data from drilled wellbores, including data on one ore more of the formation parameters, and one or more of the bit design parameters. One example embodiment uses neural network training data from nearby wellbores to train the neural network to estimate values of a formation parameter at stratigraphic depths corresponding to that of the wellbore being drilled.

DETAILED DESCRIPTION OF THE INVENTION

Figure 1:
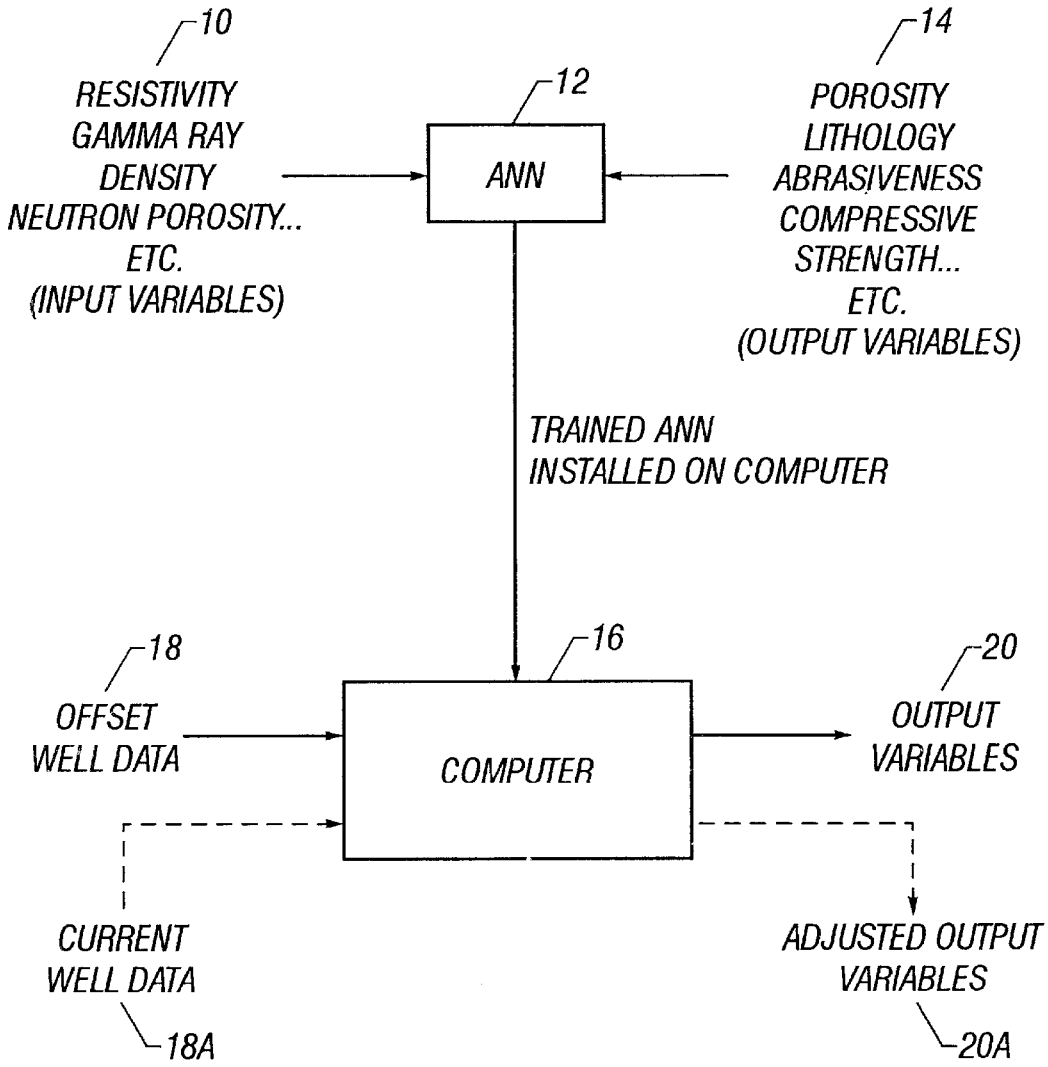
FIG. 1 shows an example embodiment of training an ANN, and using a trained ANN to develop correspondence between measurements of formation properties and drillability-relate properties of earth formations.

Generally speaking, the various aspects of the invention include training and using ANNs to determine suitable drilling operating and drill bit design parameters for drilling earth formations. ANNs offer significant improvements over traditional methods for determining correspondence between independent and dependent variables, such as linear regression or algorithmic relationships (deterministic) techniques, because 1) the functional relationships between the independent and dependant variables need not be known or estimated in advance, and 2), the output values (dependent variables) are not forced to lie near average values based on the determined functional relationship between independent and dependent variables (i.e. any variations in the data are preserved). ANNs provide a reliable empirical method with accurate results, easily tested and confirmed. In the various aspects of the invention, an ANN is trained using various measurements related to properties of earth formations. The trained ANN can be used to determine, among other things, preferred design parameters for a drill bit used to drill selected earth formations, expected drilling (economic) performance of the bit, and preferred drilling operating parameters for drilling the selected earth formations. Additionally, the trained ANN can be used to simulate the expected economic performance of a selected design drill bit when drilling selected earth formations.

In this embodiment of the invention, the ANN used is a program sold by Petroleum Software Technologies, Denver, Colo., under the trade name "NNLAP". It should be understood that the type of ANN program used is a matter of discretion for the designer and is not intended as a limitation on the invention.

The detailed description which follows is separated for clarity into several parts. These include: 1) Determining Physical Properties of Earth Formations, 2) Optimal Drill Bit Design and Drill Bit Selection for Drilling Earth Formations Having Particular Properties, 3) Optimal Drilling Operating Parameters for a Selected Drill Bit Design, 4) Anticipated Economic Performance of a Selected Drill Bit Design in the Earth Formations Having Particular Properties, 5) Simulation of Performance Improvements by Varying any of the Available Input Parameters, and 6) Application of the Method of the Invention to Percussion Drilling.

1) Determining Physical Properties of Earth Formation

In one aspect of the invention an ANN is trained to determine relationships between measurements of certain parameters of the earth formations and physical properties of these earth formations which may affect the speed and/or economy with which these formations may be drilled. The requirements of a "training data set" used to train the ANN are that both input variable(s) and a desired output (i.e. a known result) are present in the training data set. In this aspect of the invention, training of the ANN to define aspects of the physical properties of the earth formations can be performed using data taken from a previously drilled wellbore located in the geographic vicinity of a wellbore to be drilled, or can be taken from data derived from an existing well bore while drilling is in progress. The training set can also be derived from data measured in any area of the world where measurable and definable characteristics of earth formations could show a reasonable correspondence to drilling performance. Any single one or any combination of a plurality of measurable, definable, or calculable parameters relating to properties of earth formations can be made available as input variables to train the ANN. These input parameters can include:

a) any type of geophysical instrument measurement taken from a wellbore adjacent to a formation of interest at any depth interval in the well bore being drilled and associated with that depth interval, or from a similar earth formation above or below the depth interval within the same well bore. The geophysical measurements may also be taken from formations in other geographic areas known or believed to have physical properties similar to the formations of interest. The instrument measurements can include, individually or in any combination thereof, well known measurements such as: gamma ray, electrical resistivity, SP (spontaneous potential), caliper, bulk density, neutron porosity, acoustic velocity both shear and compressional, photoelectric factor, temperature, formation pore pressures, annular mud (drilling fluid) pressures, formation fluid types and concentrations, nuclear magnetic resonance T1 and/or T2 distributions, and any calculated porosity, permeability, resistivity, conductivity measurements derived from these measurements.

b) any experimentally or laboratory derived data from one or more samples of an earth formation removed, collected or preserved during a drilling operation. These data can include, individually or in any combination thereof: porosity, permeability, uniaxial (unconfined) rock compressive strength, triaxial (confined) rock compressive strength, Poisson's ratio, as bulk, shear, compressibility, or Young's moduli, lithology (mineral composition), composition of any intergranular cementing agents, grain size and/or grain shape distributions, pore shape and size, pore fluid types and concentrations) any of which may be determined using well known formation sample analysis techniques.

c) any conditions present during drilling of the wellbore used to derive the training well data set. These drilling conditions may include, individually or in any combination thereof, the drill bit type used, weight on bit (axial force applied to the bit while drilling the wellbore), rotary RPM (rotation speed applied to the drill bit), rotary torque applied to the drill bit, flow rate of drilling fluid circulation through the drill bit while drilling, the drilling fluid type and properties of the drilling fluid such as fluid density, the hydraulic horsepower applied to the drilling fluid system, standpipe pressure, and other drilling fluid properties such as plastic viscosity (PV), yield point (YP), solids content, fluid loss rate, gel strength, bottom hole assemble design and components, MWD /LWD (Measurement While Drilling/Logging While Drilling) logs, well inclination and directional survey data, any monitored condition(s) of the drill bit at surface or downhole instrumentation that are stored and retrieved from a memory device or telemetry or conductor conveyed to the surface.

The ANN can then be trained using any one of the foregoing, or any combination of the foregoing as input variables to identify and determine relationships with respect to attributes of earth formation(s) of interest. The output variables (formation attributes) for training the ANN in this aspect of the invention are generally related to attributes which are believed to have an effect on the speed and/or economy with which a particular earth formation can be drilled. These attributes can include, individually or in combination, but are not limited to:

a) rock mineral composition (lithology);

b) primary porosity (fractional volume of pore space);

c) secondary porosity;

d) permeability;

e) rock compressive strength—confined or unconfined;

f) rock shear strength;

g) principal stresses and/or strains;

h) rock abrasiveness;

j) impact potential;

k) intergranular cementing agents;

l) fluids disposed in the pore spaces of the formation—types and concentrations;

compressive to shear acoustic velocity ratios; and m) any other rock mechanical properties such as Poisson's ratio, Young's/bulk/shear compressibility moduli, or angle of internal friction;

n) formation fluid pressure and differential pressure between the formation fluid pressure and hydrostatic pressure of the drilling fluid at the depth of the formation.

Referring to FIG. 1, data from the input variables used to train the ANN 12 are shown at 10. Output variables used to train the ANN 12 are shown at 14. The ANN 12 trained using the input and output variables described above can be installed on a computer 16. In one embodiment of the invention, the computer 16 may be disposed at a wellbore drilling location or at any other location convenient for the system operator. Measurements corresponding to any one or any combination of the input variables according to this aspect of the invention, shown at 18 can be entered into the computer 16, having installed thereon the trained ANN, to generate an output variable set 20 having any one or combination of the output variables described above. Sources of the input variable set 18 for analysis using the trained ANN (on computer 16) can include, but are not limited to, wireline conveyed well logging instruments, MWD/LWD instruments (either in "real time" or "memory" modes), analysis of core samples or drill cuttings or the like.

In a particular embodiment of this aspect of the invention, anticipated values of any one or combination of the input variables to be entered into the trained ANN are determined by correlation with measurements made in corresponding earth formations from wellbores drilled close by the wellbore of interest. A feature of this embodiment of the invention includes adjusting the values of the output variables from the trained ANN to account for differences in values of the input variables determined by measurements made at the wellbore being drilled, such as by MWD/LWD, wireline logging, cuttings or core analysis or the like. In FIG. 1, measurements made of any one or combination of parameters corresponding to the same one or combination of input variables are shown at 18A as being entered into the computer 16. Adjusted output variables from the computer are shown at 20A. Alternatively, the output variable set 20A can be determined entirely from measurements made at the wellbore being drilled, such as shown at 18A in FIG. 1. The alternative input variable set 18A would be used alone in situations where no offset wellbore data are available. In these cases, the output variable set 20A can be generated by the computer 16 using only measurements made at the wellbore being drilled.

In a particular example embodiment of the invention, data measured from the wellbore being drilled, such as by LWD/MWD, cuttings analysis or the like are entered into the computer 16 substantially as the data are acquired. Output variables are generated by the trained ANN on the computer substantially in "real time" as the input variables are entered into the computer 16.

Figure 2:
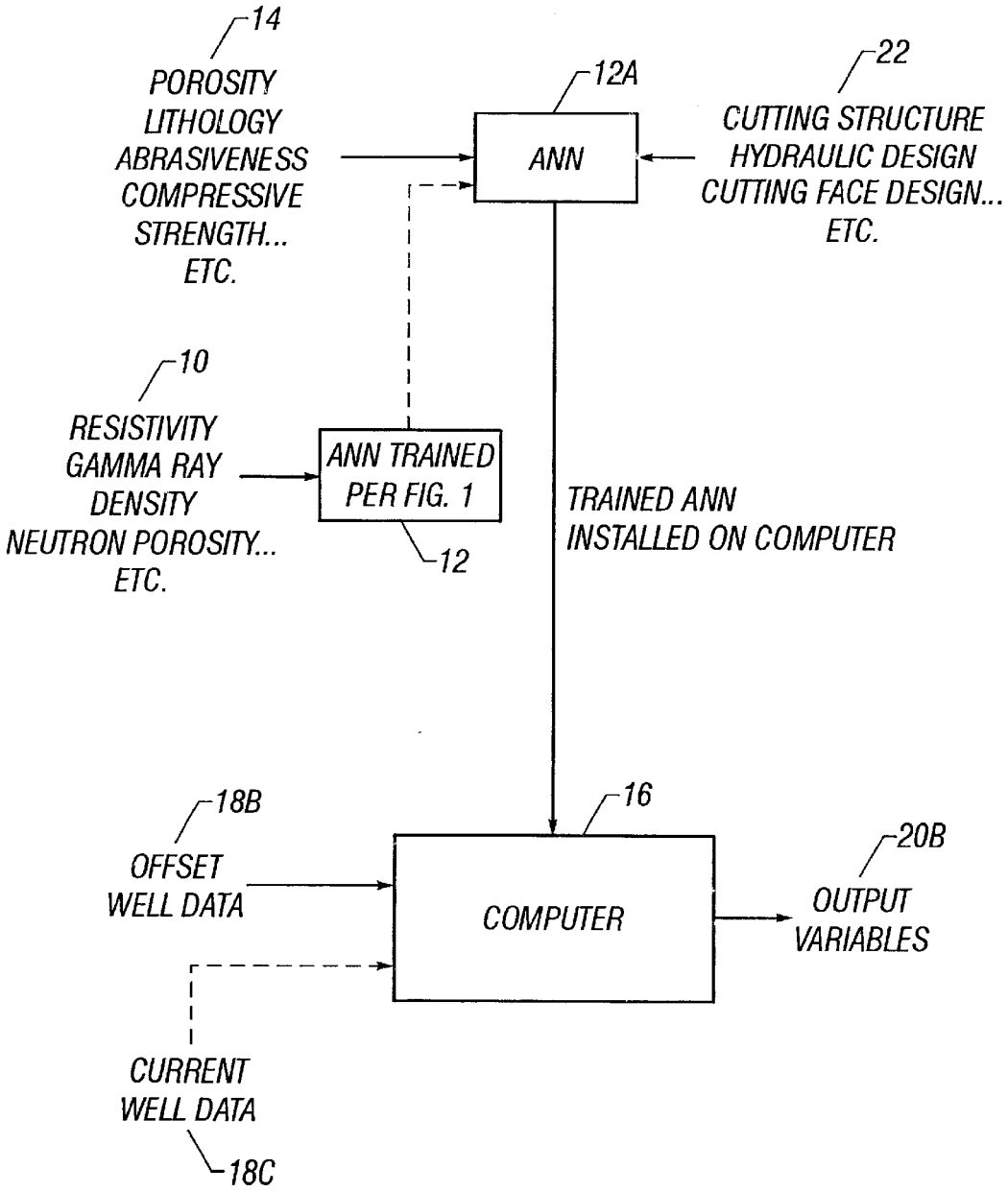
FIG. 2 shows an example embodiment of training an ANN, and using a trained ANN to develop correspondence between formation drillability properties and bit design parameters.

2) Optimal Drill Bit Design Components and Drill Bit Selection for Drilling Earth Formations Having Particular Properties In addition to the relationships between any one or more of the foregoing input variables (10 in FIG. 1) and any one or more of the output variables (20 in FIG. 1) above as determined by training the ANN (12 in FIG. 1), the ANN can be also be trained to identify drill bit design characteristics and features shown by experience to be effective when used in the drilling environment characterized by one or more of the output variables previously identified and characterized. The data on drill bit design features and characteristics may be taken from actual bit runs of various types and designs of drill bits used to drill particular earth formations. Referring to FIG. 2, the ANN, shown at 12A can be trained by entering such bit run data, as shown at 22. The earth formations may have physical parameters determined as in the previous aspect of the invention (by any one or combination of the output variables), as shown at 14, or the formations may be characterized using any one or any combination of the input variables used to train the ANN as described in the previous aspect of the invention. This is shown as measurements at 10 being entered into the ANN 12 trained as previously described. Output variables from the previously trained ANN 12 represent substantially the same type of characteristics of the earth formations as the physical parameters shown at 14.

The output variables for training the ANN in this aspect of the invention, shown at 22 in FIG. 2, are related to the various design parameters for a drill bit. The output variables in this aspect of the invention can include, individually or in any combination thereof, but are not limited to:

a) drill bit cutting structure
   - insert, tooth or cutter type or material
   - insert, tooth or cutter size or shape
   - insert, tooth or cutter count
   - insert, tooth or cutter deployment pattern across the face of the drill bit
   - insert, tooth or cutter type or material, size or shape, deployed in the gauge drilling/protection area of the bit's outer diameter or vicinity.

b) drill bit hydraulic nozzle design
   - type and placement about the face and gauge areas of the drill bit
   - "junk slot" area, "junk slot" geometry, total face volume for drill cuttings removal, cleaning and cooling of the bit cutting structure.

c) drill bit face blade design—blade count, blade shape, geometry and profile, blade arrangement d) drill bit bearing system design—bearing materials, geometry, load requirements optimization e) drill bit lubrication system design—lubricant type and properties optimization f) drill bit seal system design—seal dimensions, seal material(s), seal placement, sealing pressure requirements.

g) bit type and/or IADC (International Association of Drilling Contractors) classification. It is within the contemplation of this aspect of the invention that an output of the ANN 12A can include whether, for example, the drill bit should be roller cone type or fixed cutter type, and/or the particular IADC classification for the bit given the particular values of the set of input variables entered into the ANN 12A.

Note item (g) in this non-exclusive list of parameters contemplates that the design parameter output of the ANN 12A may be a type of drill bit and/or its industry classification, separately or in addition to the various individual design parameters described above. Item (g) contemplates that the ANN 12A can be trained using data from actual bit runs in other wellbores, wherein the properties of the earth formations through which the wellbores are drilled, and the drilling operating parameters are entered into the ANN 12A to train it, along with the design features of the drill bit used in each bit run. The ANN 12A will then be trained to provide an output which represents a selection of a particular drill bit, either by bit type (e.g. roller cone or fixed cutter) and selected features (e.g. number of and/or type of cutting elements, cutting element spacing). Alternatively, the output of the ANN 12A can be characterized according to IADC code of the particular drill bit. The result is that the output of the trained ANN 12A provides the system user with a bit selection based on anticipated earth formations to be drilled.

The ANN 12A is trained using the foregoing as input and output variable sets. The trained ANN 12A can be installed on the computer 16, or any other suitable computer, and used to assist in selecting drill bit design parameters which are most likely to successfully drill an earth formation having particular physical properties. The combination of selected ones of the above drill bit design parameters would identify the most appropriate drill bit parameters to drill the formation interval having the particular physical properties.

This aspect of the invention can be embodied to operate from either or both of offset wellbore data 18B and data from the wellbore currently being drilled 18C. In either case, values of formation parameters used as input variables to the trained ANN on the computer 16 can be estimated by correlation with values taken from the offset wellbores, and/or can be estimated using measurements made in the current wellbore. If current wellbore measurements 18C are used, they may be of the physical properties of the formation directly, or may be inferred from such data as MVVD/LWD measurements used as input to the ANN 12 trained as in the previous aspect of the invention. Output variables shown at 20B in FIG. 2 represent the bit design parameters (and/or bit type or classification) for the particular formation most likely to drill successfully.

In a particular example embodiment of the invention, data measured from the wellbore being drilled, such as by LWD/MWD, cuttings analysis or the like are entered into the computer 16 substantially as the data are acquired. Output variables are generated by the trained ANN on the computer substantially in "real time" as the input variables are entered into the computer 16.

3) Optimal Drilling Operating Parameters for a Selected Drill Bit Design in Earth Formations Having Particular Properties The previous two aspects of the invention concern characterizing earth formations according to drilling performance and/or economy related properties, and determining drill bit design features (or parameters) which are shown to quickly and/or economically drill the formations having the particular "drillability" properties. In the present aspect of the invention, the ANN can be trained to enable identification of optimal drill bit operating conditions for a selected drill bit type or design, used in earth formations having particular physical properties.

Figure 3:
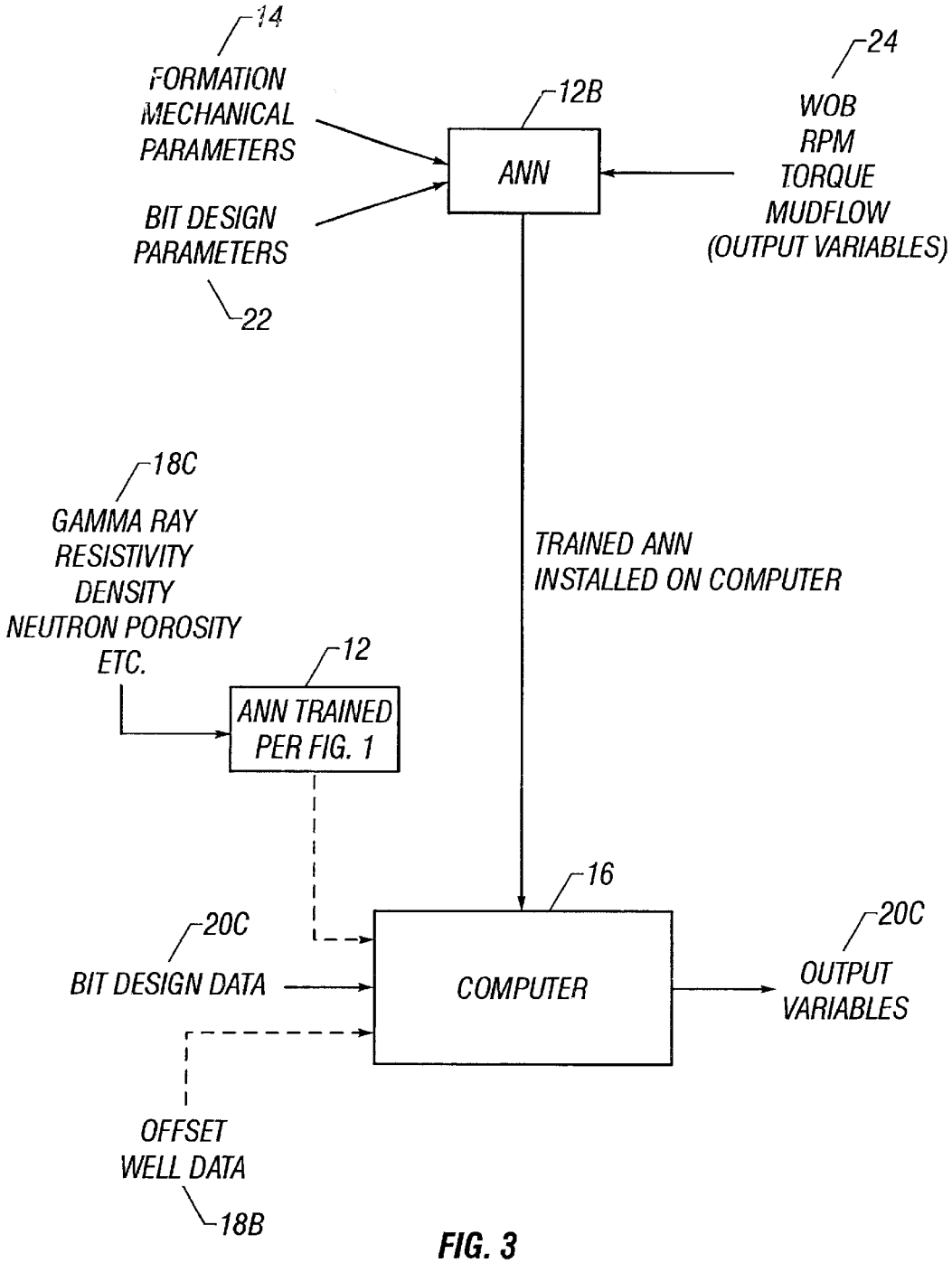
FIG. 3 shows an example embodiment of training an ANN, and using a trained ANN to develop correspondence between formation drillability properties, bit design parameters and optimal drilling conditions.

Training the ANN according to this aspect of the invention can include as an input data set:

a) any one or any combination of the bit feature parameters such as those determined in the output data set from the drill bit type and feature component design characterization as in the previous aspect of the invention (which may include bit type and/or IADC classification)

b) any one or any combination of physical properties such as those determined in the output data derived from the earth formation characterization as in the first aspect of the invention. Alternatively, the input data set may include any one or any combination of the measurement data used to train the ANN as in the first aspect of the invention Referring to FIG. 3, The ANN 12B can be trained according to this aspect of the invention using as input variables the types of data described above to identify and determine a relationship between these data and any known drill bit operating condition. In FIG. 3, formation drillability of mechanical properties are shown at 14. As explained above, these training input variables may be direct measurements of formation parameters such as resistivity, density, etc., or may be drillability-related parameters, determined as in the first aspect of the invention or determined directly. The other input variables, shown at 22 in FIG. 3, include bit design parameters, as explained earlier. Corresponding to these formation parameters as input variables are the output variables, shown at 22. The output variables 22 used to train the ANN 12B, are values of drilling operating conditions (parameters) known to be appropriate to operate in the drilling environment (formation properties and bit parameters) so identified and characterized in an economically and/or mechanically efficient manner. The output variables for training the ANN 12B in the present aspect of the invention can include, individually or in any combination thereof, but are not limited to:

a) weight on bit (WOB) axial force applied to the bit while drilling the borehole;

b) rotary RPM—rotation speed of the bit;

c) torque applied to the drill bit;

d) drilling fluid circulation rate through the drill bit while drilling, e) drilling fluid type f) drilling fluid density g) hydraulic horsepower h) standpipe pressure j) other drilling fluid properties
plastic viscosity (PV),
yield point (YP),
solids content,
fluid loss parameters,
gel strength.

A result of training the ANN 12B according to this aspect of the invention is that relationships can be determined between formation properties known to affect drilling speed and/or economy, drill bit design parameters and the speed and/or economy of drilling can be determined.

The ANN 12B trained according to this aspect of the invention can be installed on the previously described computer 16, or any other suitable computer, and used to evaluate and/or select drilling operating conditions which are likely to economically and/or efficiently drill a wellbore. When used to select drilling operating conditions, inputs to the trained ANN 12B on the computer 16 can include formation parameters correlated from offset wellbores, shown at 18B in FIG. 3. The formation parameters from offset wells may include measurements of resistivity, gamma ray, bulk density, etc. input directly to the computer 16, or may include formation mechanical (drillability) properties such as form the output variables (20 or 20A in FIG. 1) according to the first aspect of the invention. Alternatively, measurements made in the wellbore being drilled, such as MWD/LWD can be entered into the ANN trained as in the first aspect of the invention, to provide an equivalent input variable set. Drill bit parameters for the bit being used to drill the wellbore are entered as input variables, as shown at 20C in FIG. 3. Output variables, shown at 20C in FIG. 3, include any one or combination of the previously described drilling operating conditions.

In a particular embodiment of this aspect of the invention, values of any one or combination of the drilling operating conditions determined by the computer 16 having the trained ANN 12B according to this aspect of the invention installed thereon can be used to adjust values of drilling operating conditions used to drill the wellbore. The values of the one or combination of drilling operating conditions 20C are determined by the trained ANN 12B on the computer 16 in response to drill bit parameters 20C and formation properties. The formation properties can either be correlated from offset well data 18B, or determined from measurements on the wellbore being drilled 18C.

In a particular example embodiment of the invention, data measured from the wellbore being drilled, such as by LWD/MWD, cuttings analysis or the like are entered into the computer 16 substantially as the data are acquired. Output variables are generated by the trained ANN on the computer substantially in "real time" as the input variables are entered into the computer 16.

4) Anticipated Economic Performance of a Selected Drill Bit Design in Earth Formations Having Particular Properties Relationships between the earth formation properties, drill bit design parameters and drilling conditions (drilling operating parameters) determined in, or used as input variables for, the previous aspects of the invention can be also used to train the ANN. Input data sets used to train the ANN according to this aspect of the invention can include:

a) drilling operating parameters such as those determined in the Optimal Drilling Conditions aspect of the invention above;

b) drill bit parameters such as those described in the second aspect of the invention above; and c) properties of the earth formation which affect drilling, such as those described in the output data for the first aspect of the invention above. Alternatively, the properties of the earth formation may be entered as input data from instrument and/or laboratory measurement, just as in the first aspect of the invention.

Output variables for training the ANN according to this aspect of the invention can include any one or combination of the following, but are not limited to any or all of these:

a) drilling rate of penetration (ROP), namely the rate of progress of the well boring operation, usually measured in feet or meters per hour. Operating costs per hour influence the overall financial cost of the drilling operation;

b) drilling hours accumulated on the drill bit run of interest, used for determining the expected remaining life of the drill bit. Predictions of the expected remaining life of the bit are used for preventing catastrophic failure of the drill bit, which may necessitate unplanned and/or unnecessary expense of failed bit recovery operations;

c) total distance (feet or meters) along the well path drilled during a particular drill bit run;

d) total revolutions available for a particular bit run;

e) maintenance of the planned well path along a selected trajectory;

f) assessment, prediction and control of the degradation of the drill bit cutting structure and bearing wear condition (where applicable) to achieve either or both economic viability and operational objectives (well path, borehole stability, minimize damage to potential producing target formations), i.e. a planned expenditure of the drill bit's useful life.

Figure 4:
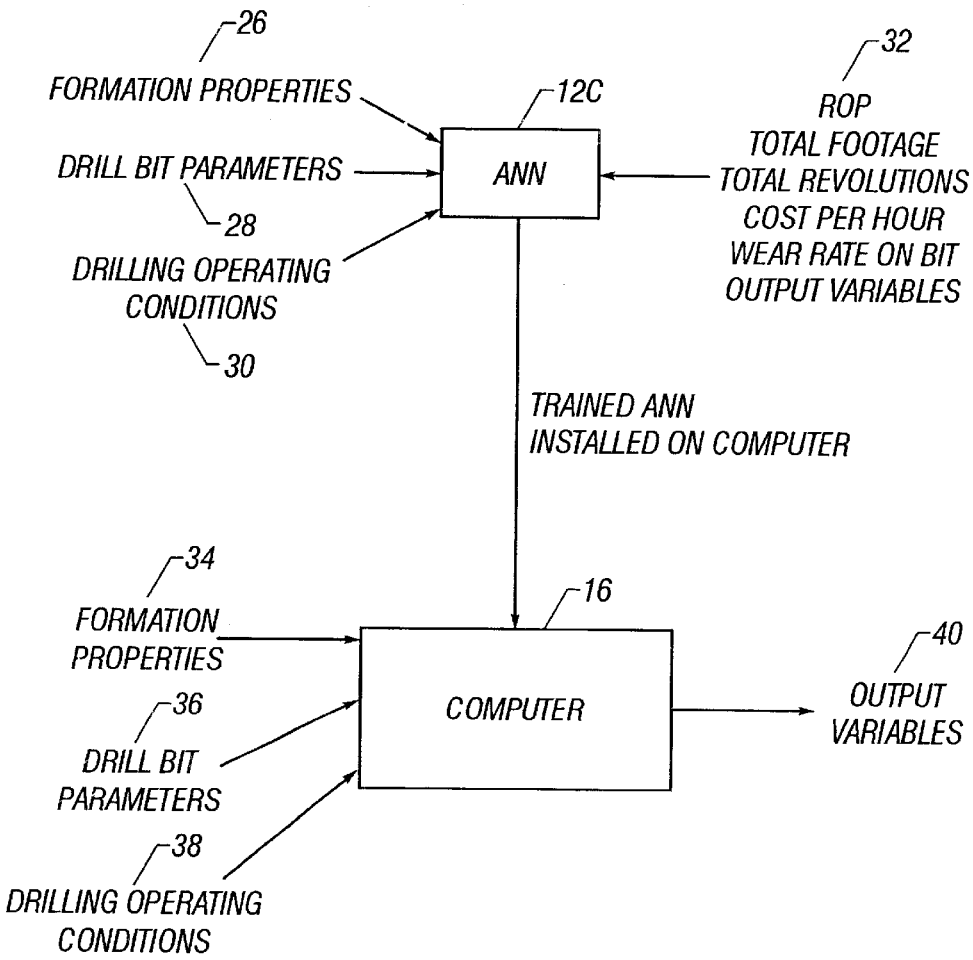
FIG. 4 shows an example embodiment of training an ANN, and using a trained ANN to develop correspondence between formation drillability properties, bit design parameters, drilling conditions, and economic performance of a drill bit.

Referring to FIG. 4, the input variables for training the ANN 12C according to this aspect of the invention typically include drillability-related properties of the formation, generally as previously described and shown at 26, drill bit parameters, shown at 28, and drilling operating conditions, shown at 30. The data for the input variables is typically obtained from bit run records. Bit run records can be correlated to formation evaluation records, such as well logs, cuttings and/or core analysis as previously explained, to form the input variable set. Output variables for training the ANN 12C can include any one or combination of the parameters described above such as ROP, drilling hours, wear and/or wear rate on the bit, etc as shown at 32 in FIG. 4.

The ANN 12C trained according to this aspect of the invention can be used in the computer 16, or any other suitable computer, to affect ones of the input variables subject to operator control. The input variables which as subject to operator control include the drill bit parameters and the drilling operating conditions. In a particular embodiment of this aspect of the invention, any one or combination of the drill bit parameters 36 and drilling operating parameters 38 can be adjusted during drilling of a wellbore to achieve optimal values of any one or any combination of the output variables, shown at 40 in FIG. 4. Typically, data concerning properties of the earth formation being drilled or to be drilled will be entered as input to the computer 16, shown at 34 in FIG. 4. As in previous aspects of the invention, the formation properties 34 can be determined from offset wellbore data, or from measurements made in the wellbore being drilled.

In a particular example embodiment of the invention, data measured from the wellbore being drilled, such as by LWD/MWD, cuttings analysis or the like are entered into the computer 16 substantially as the data are acquired. Output variables are generated by the trained ANN on the computer substantially in "real time" as the input variables are entered into the computer 16.

5) Simulation of Performance Improvements by Varying any of the Available Input Parameters Training of the ANN to simulate changes in drilling performance for a selected drill bit type or bit design can also be performed using one or more of the following as input variables to train the ANN:

a) the output data derived from the Optimal Drilling Conditions determined for various drill bits described above;

b) the output data derived from the drill bit parameter determination described above, c) output data derived from formation characterization as described above, d) data from a previously drilled wellbore in the geographic vicinity of a wellbore to be drilled;

e) data derived from a well bore in progress;

Data for the input variables may be obtained from any area of the world where measurable and definable characteristics of earth formations could show a reasonable correspondence to drilling operating conditions. Previous drilling experience with particular bit designs in similar earth formations can also be used. Similar in this context means having similar mechanical properties generally as defined for the output variables in the first aspect of the invention. Any individual or combination of these measurable, definable, or calculated variables, are made available as input variables to train the ANN, as are the drill bit economic performance experience results, such as ROP, drilling hours achieved on a particular bit run, total distance drilled by the drill bit, and the wear rates on the bit (dull bit condition).

In this aspect of the invention, the ANN can be trained on any one or combination of the foregoing input data types just described to simulate the expected changes in drill bit performance with respect to changes in any one or any combination of the input variables.

Output variables from the ANN in this aspect of the invention could include any one or combination of:

a) changes in ROP;

b) changes in drilling hours accumulated on the given bit run of interest—determining the viable life of the drill bit, preventing catastrophic failure of the drill bit, then necessitating unplanned/unnecessary expense of recovery operations;

c) changes in the total distance (feet or meters) along the well path drilled in a particular bit run;

d) changes in the total revolutions accomplished by the given bit run;

e) changes in the assessment, prediction and control of the degradation of the drill bit cutting structure and bearing wear condition to achieve both economic viability and operational objectives (well path, borehole stability, minimize damage to potential producing target formations), i.e. a planned expenditure of the drill bits useful life.

If the data set used for the input variables and output variables is large enough, correspondence between changes in the input variables and output variables may be sufficient to train the ANN without further data. Typically, data from a large number of bit runs for various types of bits are available or can be made available from drill bit manufacturers, Data from the bit runs will generally include enough information so that correspondence between changes in any one or combination of the input variables and any one or combination of the output variables will be sufficiently determinable to train the ANN.

If insufficient data are available from bit runs to train the ANN, data may also be obtained by such methods as laboratory experiment. In one example of such laboratory experiment, a test drilling apparatus may be arranged to drill samples of formations having selected mechanical properties. RPM and or WOB (as previously defined) may be varied, and changes in ROP and or torque (also as previously defined) measured as the WOB and RPM are changed, may be used as output variables to train the ANN. As previously explained, the ANN can be trained using changes in any one or any combination of any of the input variables previously described, and the corresponding changes in any one or any combination of the previously described output variables measured and used to train the ANN.

One application for this embodiment of the invention includes estimating changes in drilling performance as a result of changing one or more drill bit design parameters. The trained ANN is used in this application by adjusting the one or more of the bit design parameters and observing the change in the expected drilling performance.

Figure 5:
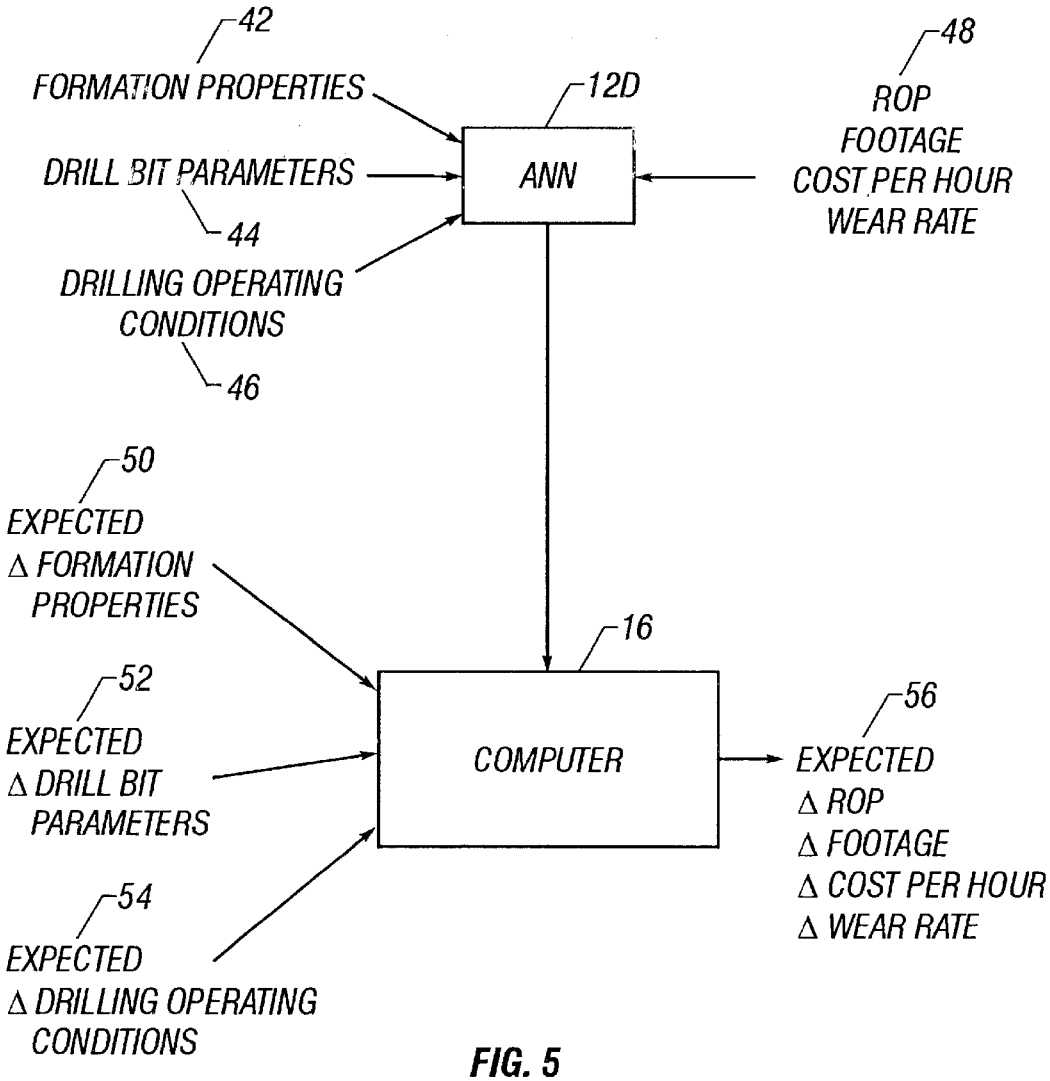
FIG. 5 shows an example embodiment of training an ANN, and using a trained ANN to develop correspondence between changes in any one or combination of formation drillability properties, bit design parameters, drilling conditions, and corresponding changes in economic performance of a drill bit.

Referring to FIG. 5, training the ANN 12D according to this aspect of the invention includes providing input data sets, shown as changes in formation properties at 42, changes in drill bit parameters 44 and changes in drilling operating conditions 46. As previously explained, the changes in the various input parameters can be determined directly if there are enough data available from bit runs.

Alternatively, as previously explained, laboratory data or the like may be used to develop the relationships between changes in the input variables and changes in the output variables for this aspect of the invention. Output variables 48 used to train the ANN 12D in this aspect of the invention includes changes in any one or combination of the previously described output variables.

The trained ANN 12D may be installed on the computer 16 or any other suitable computer to provide analysis of expected changes in any one or combination of the output variables, shown at 56, corresponding to changes in any one or combination of the input variables, 50, 52, and 54 in FIG. 5.

6) Application of the Method of the Invention to Percussion Drilling

The foregoing description of the various aspects of the invention was directed to various types of so-called "rotary" drilling, wherein the drill bit is turned to cause it to cut through the earth formations. The method of the invention, however is also applicable to "percussion" drilling. In percussion drilling, a drilling fluid circulated under pressure provides the energy to drive a device such as a thruster or hammer which is disposed in the wellbore. A special bit is attached to the output end of the hammer or thruster. The drilling fluid usually comprises air (or a mixture of air with other selected gases), foam or conventional liquid drilling fluid (drilling "mud"). The drilling fluid is pumped under pressure through the drill string to the hammer device and hammer drill bit at depth in the wellbore. As the drilling fluid passes through the typical hammer, a series of ports, valves and/or flow passages direct the fluid flow to cause reciprocation of a piston. The piston has a selected mass. The reciprocation typically ranges from 15 to 60 Hz (cycles per second). The reciprocating piston strikes the back of the hammer drill bit, which in turn conducts the energy in the reciprocating piston to the rock face. The transferred energy causes the rock to mechanically fail in a series of fractures, resulting in drill cuttings or chips. The drilling fluid, after passing through the hammer/thruster device, exits through a series of configured ports or nozzles at the face of the hammer drill bit. The fluid leaving the hammer drill but serves to remove the rock cuttings from the drilling face, and to transport these cuttings from the bottom of the wellbore to the earth's surface.

Drilling efficiency of the hammer/thruster in combination with the hammer drill bit, is affected by several drilling operating parameters which are similar to those in rotary drilling. These drilling operating parameters include:

1) weight on bit (WOB)—axial force applied to the bit from thick-walled steel tubular members of the drill string. WOB is used in percussion drilling only to "close" the tool, meaning to engaging the piston in the hammer. The piston motion provides substantially all the drilling force in percussion drilling. The amount of weight on bit can have an effect on the efficiency of percussion drilling.
2) rotary speed (RPM)—rotation of the drill bit is required to present a fresh surface of the drilling face to the cutting structure of the hammer drill bit. The rotation can be provided from surface, a conventional rig floor drive system from the drilling rig, from a down-hole motor (such as a positive displacement mud motor or turbine), or from an indexing mechanism in the hammer/thruster device. RPM can be optimized to improve drilling efficiency and economic performance of the percussion drilling system.
3) circulating drilling fluid pressure—is measured (at surface or down-hole), recorded, analyzed and observed to optimize the hammer/thruster tool efficiency. This parameter can be optimized to improve drilling efficiency and economic performance of the percussion drilling system.
4) drilling torque—is measured (at the earth's surface or at a location in the drill string), recorded, analyzed and observed to optimize the hammer/thruster tool efficiency. Torque can be optimized to improve drilling efficiencies and economic performance of the percussion drilling system.

The circulating pressure of the drilling fluid typically includes a pressure variation having a frequency related to the movement of the piston in the hammer. Presence of the pressure variation, and its amplitude and frequency, are related to the efficiency of the hammer device. It is known in the art to measure the circulating fluid pressure and spectrally analyze the measurements. Spectral analysis can be performed by any means known in the art, preferably using a fast Fourier transform or the like. The amplitude and frequency of the pressure variation thus determined can be used, in one embodiment of the invention, to train the ANN. Training may include as output data sets, for example, any combination the previously described parameters relating to drilling efficiency, such as rate of penetration, cost per unit length of wellbore drilled, and wear rate of the bit.

The previously described properties of the earth formation can also affect the efficiency of percussion drilling. In a manner similar to that described for rotary drilling, the ANN can be trained using any combination of the foregoing drilling operating parameters, as well as percussion bit design parameters and formation properties, to provide an output having preferred values of any combination of the drilling operating parameters. Training the ANN as in the previously described aspects of the invention, can be selected to provide optimal drilling efficiency, optimal economic value, or can provide optimal values of any other selected parameter.

The invention has been described with respect to particular embodiments. It will be apparent to those skilled in the art that other embodiments of the invention can be devised which do not depart from the spirit of the invention as disclosed herein. Accordingly, the invention shall be limited in scope only by the attached claims.

What is claimed is:

1. A method for selecting a design parameter for a drill bit, comprising:

entering a value of at least one property of an earth formation to be drilled by said bit into a trained neural network, said neural network trained by selecting data from drilled wellbores, said data comprising values of said at least one formation property for formations through which said drilled wellbores penetrated, and corresponding thereto values of at least one drilling operating parameter, said drill bit design parameter, and values of a rate of penetration and a rate of wear of a drill bit used on each said formation;

entering said data from said wellbores into said neural network; and selecting said design parameter based on output of said trained neural network.

2. The method as defined in claim 1 wherein said at least one property of said earth formation comprises a property selected from the group of rock mineral composition, porosity, compressive strength, abrasiveness, natural gamma ray radiation, electrical resistivity and acoustic velocity.

3. The method as defined in claim 1 wherein said design parameter comprises a cutting element type.

4. The method as defined in claim 1 wherein said design parameter comprises a cutting element count.

5. The method as defined in claim 1 wherein said design parameter comprises an hydraulic nozzle configuration.

6. The method as defined in claim 1 wherein said design parameter comprises IADC code of said drill bit.

7. The method as defined in claim 1 wherein said neural network is trained by selecting data from drilled wellbores, said data comprising values of said at least one formation property for formations through which said drilled wellbores penetrated, and corresponding thereto values of at least one drilling operating parameter, values of said drill bit design parameter, and values of at least one drilling performance parameter; and entering said data from said wellbores into said neural network.

8. A method for optimizing an economic performance of a drill bit, comprising:

entering a value of at least one property of an earth formation to be drilled by said bit into a trained neural network;

entering at least one design parameter of said drill bit into said trained neural network; and adjusting a value of at least one drilling operating parameter in response to output of said trained neural network so as to optimize a value of a parameter related to said economic performance of said bit.

9. The method as defined in claim 8 wherein said at least one formation property comprises a property selected from the group of rock mineral composition, porosity, compressive strength, abrasiveness, acoustic velocity, natural gamma radiation and electrical resistivity.

10. The method as defined in claim 8 wherein said at least one design parameter is selected from the group of bit type, IADC code, cutting element type, cutting element count and hydraulic nozzle configuration.

11. The method as defined in claim 8 wherein said economic performance parameter comprises wear rate of said drill bit.

12. The method as defined in claim 8 wherein said drilling operating parameter comprises a parameter selected from the group of weight on bit and rotary speed of said bit.

13. The method as defined in claim 8 wherein said drilling operating parameter comprises drilling fluid circulating pressure.

14. The method as defined in claim 13 wherein said drilling operating parameter further comprises an amplitude and a frequency of a pressure variation component of said fluid circulating pressure, said variation component related to operation of a drilling hammer.

15. The method as defined in claim 8 wherein said value of said at least one formation property and said at least one drilling operating parameter are entered into said neural network during drilling of said wellbore, and said value of said at least one drilling operating parameter is adjusted in response to an output of said trained neural network so as to optimize said value of said economic performance parameter.

16. The method as defined in claim 15 wherein said value of said at least one formation property is determined by logging-while-drilling instrumentation.

17. The method as defined in claim 15 wherein said value of said formation property is determined by analysis of formation cuttings.

18. The method as defined in claim 8 wherein said neural network is trained by selecting data from drilled wellbores, said data comprising values of said at least one formation property for formations through which said drilled wellbores penetrated, and corresponding thereto values of said at least one drilling operating parameter, said at least one drill bit design parameter, and values of said economic performance parameter; and entering said data from said wellbores into said neural network.

19. The method as defined in claim 8 further comprising determining said value of said at least one formation property during drilling of a wellbore, and adjusting said value of said at least one drilling operating parameter in response to changes in said value of said at least one formation property, said value of said at least one formation property determined during drilling by entering values of said at least one formation property with respect to depth from nearby wellbores into said neural network so as to train said neural network to calculate expected values of said at least one formation property in said wellbore being drilled at corresponding stratigraphic depths therein.

20. The method as defined in claim 8 wherein said economic performance parameter comprises a cost to drill a selected portion of a wellbore.

21. The method as defined in claim 8 wherein said economic performance parameter comprises a distance drilled by a single drill bit.

22. The method as defined in claim 8 wherein said economic performance parameter comprises an amount of damage to a producing earth formation.

23. The method as defined in claim 8 wherein said economic performance parameter comprises degree of departure from a planned wellbore trajectory.

24. The method as defined in claim 8 further comprising changing said at least one drill bit design parameter in response to the output of said trained neural network so as to optimize said value of said parameter related to economic performance.

25. A method for estimating change in economic performance of a drill bit in response to change in an input parameter, comprising:

entering a value of at least one property of an earth formation to be drilled by said bit into a trained neural network;

entering at least one design parameter of said bit into said trained neural network;

entering at least one drilling operating condition into said trained neural network; and varying at least one of said at least one property of said earth formation, said at least one design parameter and said at least one drilling operating condition and determining a change in a value of at least one parameter related to said economic performance of said bit.

26. The method as defined in claim 25 wherein said at least one formation property comprises a property selected from the group of rock mineral composition, porosity, compressive strength, abrasiveness, acoustic velocity, electrical resistivity and natural gamma radiation.

27. The method as defined in claim 25 wherein said at least one design parameter comprises a parameter selected from the group of cutting element type, cutting element count and hydraulic nozzle configuration.

28. The method as defined in claim 25 wherein said at least one drilling operating parameter comprises a parameter selected from the group of weight on bit, rotary speed of said bit and drilling fluid flow rate.

29. The method as defined in claim 25 wherein said at least one drilling operating parameter comprises drilling fluid circulating pressure.

30. The method as defined in claim 29 wherein said at least one drilling operating parameter further comprises an amplitude and a frequency of a pressure variation component of said fluid circulating pressure, said variation component related to operation of a drilling hammer.

31. The method as defined in claim 25 wherein said at least one economic performance parameter comprises a wear rate of said drill bit.

32. The method as defined in claim 25 wherein said neural network is trained by selecting data from drilled wellbores, said data comprising values of said at least one formation property for formations through which said drilled wellbores penetrated, and corresponding thereto values of said at least one drilling operating parameter, said at least one drill bit design parameter, and values of said at least one economic performance parameter; and entering said data from said wellbores into said neural network.

33. The method as defined in claim 25 wherein said economic performance parameter comprises cost to drill a selected portion of a wellbore.

34. The method as defined in claim 25 wherein said economic performance parameter comprises a distance drilled by a single drill bit.

35. The method as defined in claim 25 wherein said economic performance parameter comprises an amount of damage to a producing earth formation.

36. The method as defined in claim 25 wherein said economic performance parameter comprises degree of departure from a planned wellbore trajectory.

37. The method as defined in claim 25 further comprising changing said at least one drill bit design parameter in response to the output of said trained neural network so as to optimize said value of said parameter related to economic performance.

* * * * *